US005404725A

United States Patent [19]

Arriulou

[11] Patent Number: 5,404,725

[45] Date of Patent: Apr. 11, 1995

[54] PROCESS AND INSTALLATION FOR PRODUCING NITROGEN AND OXYGEN

[75] Inventor: Pascal Arriulou, Saint Maurice, France

[73] Assignee: L'Air Liquide, Societe Anonyme pour l'Etude et l'Exploitation des Procedes Georges Claude, Paris, France

[21] Appl. No.: 134,545

[22] Filed: Oct. 12, 1993

[30] Foreign Application Priority Data

Oct. 27, 1992 [FR] France ..... 92 12759

[51] Int. Cl.[6] ..... F25J 3/02

[52] U.S. Cl. ..... 62/25; 62/38; 62/40

[58] Field of Search ..... 62/25, 38, 40

[56] References Cited

U.S. PATENT DOCUMENTS 4,303,428 12/1981 Vandenbussche ..... 62/38

4,883,518 11/1989 Skolaude et al. ..... 62/38

FOREIGN PATENT DOCUMENTS 680216 2/1968 Belgium .

0413631 2/1991 European Pat. Off. .

0446004 9/1991 European Pat. Off. .

3035844 5/1982 Germany .

*Primary Examiner*—Ronald C. Capossela

*Attorney, Agent, or Firm*—Young & Thompson

[57] ABSTRACT

A column (4) for producing nitrogen comprises, below the air introduction point, a section (17, 18) enriched in oxygen and a sump reboiler (9) supplied by recycled high pressure nitrogen. The expanded liquid (at 19) for supplying the overhead condenser (8) is withdrawn at an intermediate level between the level of air introduction and the reboiler, and the liquid in the sump of the column, after vaporization, constitutes a minority product of the installation consisting essentially of oxygen.

15 Claims, 3 Drawing Sheets

PROCESS AND INSTALLATION FOR PRODUCING NITROGEN AND OXYGEN

The present invention relates to a process for producing a majority of nitrogen and a minority of oxygen by distillation of a gaseous mixture, particularly air, of the type in which:

the gaseous mixture is cooled and then introduced at an intermediate level in a distillation column operating at medium pressure and equipped with a head condenser and a sump reboiler;

liquid withdrawn from the column below the point where the gaseous mixture is introduced is, after expansion to a low pressure less than the medium pressure, vaporized in the head condenser;

gaseous nitrogen is withdrawn from the head of the column and reheated, with a portion thereof being compressed to a high pressure greater than the medium pressure, cooled and introduced into the reboiler to be condensed therein; and at least a portion of the liquid nitrogen thus obtained is expanded to the medium pressure and, optionally after purification, introduced into the head of the column.

Such a process, described in EP-A-413,631 in the context of producing solely nitrogen, has the advantage of being able to control the reflux rate in the column independently of the generated nitrogen flow.

The invention has as an object to improve this process so as also to permit producing a minority of oxygen.

The invention therefore has as an object a process of the type described above, characterized in that:

the said liquid is withdrawn at an intermediate level between the level of air introduction and the reboiler; and liquid in the sump of the column is vaporized and recovered as a minority product consisting essentially of oxygen.

According to other features:

the sump liquid intended to constitute the said minority product is vaporized by the reboiler and withdrawn in gaseous form immediately above this latter;

the liquid in the sump intended to constitute the said minority product is expanded and thereafter vaporized in an auxiliary condenser provided in the upper part of the column;

the auxiliary condenser is provided below the head condenser;

the auxiliary condenser is provided in parallel with the head condenser, the said sump liquid being expanded at a pressure lower than the said low pressure.

The invention also has as an object an installation designed for carrying out such a process. This installation, of the type comprising:

a distillation column operating under a medium pressure and equipped with a head condenser and a sump reboiler;

means for compressing, purifying and cooling the gaseous mixture and introducing it at an intermediate level of the column;

means for withdrawing a liquid at a level of the column lower than the level of introduction of the gaseous mixture, means for expanding this liquid at a low pressure and means for introducing it into the overhead condenser to vaporize it;

means for withdrawing nitrogen from the head of the column, and means for reheating, compressing to a high pressure, cooling and introducing into the reboiler a portion of this nitrogen; and means for expanding at medium pressure at least a portion of the liquid nitrogen issuing from the reboiler and for introducing it into the head of the column, is characterized in that:

the level of withdrawal of the said liquid is intermediate between the level of introduction of the gaseous mixture and the reboiler; and it is provided with means for vaporizing liquid from the sump of the column and for recovering the resulting gas, consisting essentially of oxygen, as a minority product of the installation.

BRIEF DESCRIPTION OF DRAWINGS

Examples of practicing the invention will now be described with reference to the accompanying drawings, in which FIGS. 1 to 3 schematically depict three embodiments of an installation for producing nitrogen and oxygen according to the invention.

The installation shown in FIG. 1 is of the general type described with reference to FIG. 2 of the abovementioned European application 413,631. It essentially comprises an air compressor 1, an apparatus 2 for purifying the air of water and $CO_2$, by adsorption, a heat exchange line 3, a distillation column 4, a turbine 5 for air expansion, an auxiliary heat exchanger 6 and a nitrogen compressor 7. The column 4 comprises a head condenser 8 and a sump reboiler 9. This column operates under a so-called medium pressure, typically on the order of 3 to 5 bars absolute.

Figure 1:
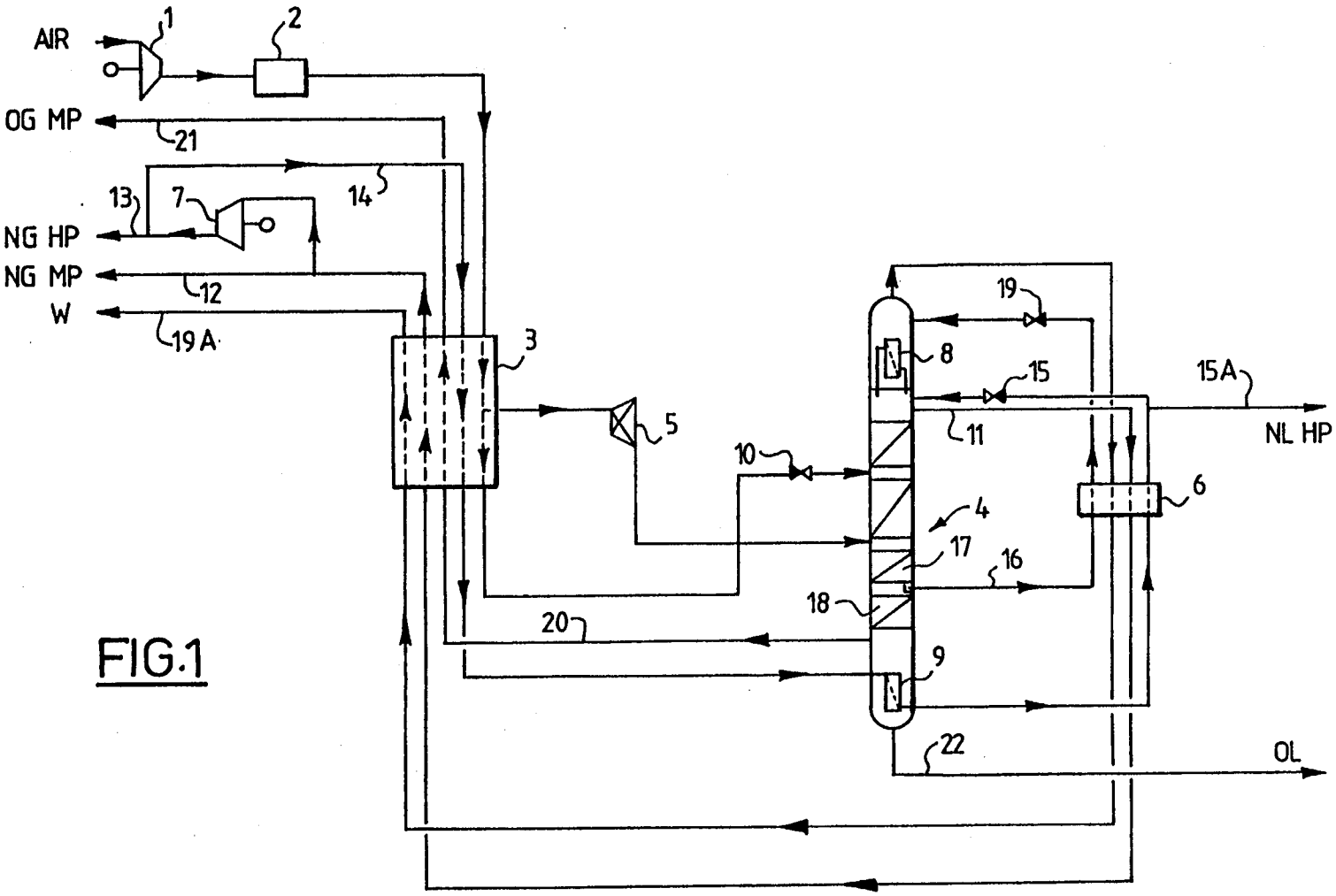

The air to be processed, compressed by the compressor 1 to a pressure significantly greater than the medium pressure and thereafter purified at 2, is cooled to an intermediate temperature in the heat exchange line 3. A fraction of the air is then removed from the heat exchange line, expanded to the medium pressure in the turbine 5 and introduced at an intermediate level into the column The rest of the air continues to be cooled to the point of liquefaction and supercooling and, after expansion in an expansion valve 10, is introduced into the column 4 above the first air flow described above.

Gaseous production nitrogen is withdrawn from the head of the column via a conduit 11, reheated at 6 and thereafter at 3, and recovered as a first product (medium pressure gaseous nitrogen) via a conduit 12.

An adjustable flow rate of medium pressure nitrogen is taken out of the conduit 12 and compressed to a high pressure by the compressor 7. A portion of the high pressure nitrogen may constitute a second product of the installation, recovered via a conduit 13, and the rest is recycled via a conduit 14, cooled up to the cold end of the exchange line 3 and sent into the reboiler 9, where it is condensed.

The liquid nitrogen thus obtained, supercooled at 6, is expanded in an expansion valve 15 and injected to reflux in the head of the column 4, a portion of this liquid nitrogen being recoverable as a third product (liquid nitrogen under high pressure) via a conduit 15A.

A liquid, termed "rich liquid" is withdrawn, via a conduit 16, at an intermediate level between the introduction level of the turbined air and the reboiler, which is to say that there are a certain number of distillation plates 17 between the conduit 16 and the introduction of turbined air and a certain number of plates 18 below the conduit 16. This liquid is supercooled at 6, expanded to a low pressure slightly greater than atmospheric pressure in an expansion valve 19, and introduced into the condenser 8, where it vaporizes. The vaporized rich liquid, after reheating at 6 and thereafter in the heat exchange line 3, is evacuated via a conduit 19A, thereby forming the residual gas W of the installation.

The liquid in the sump of the column, which cools the reboiler 9, consists of oxygen having a desired impurity content. A relatively slight flow rate of this liquid, on the order of several percent of the entering air flow rate, is vaporized by the reboiler 9 and withdrawn from the column in gaseous form immediately above this latter via a conduit 20, there being no distillation plate between the reboiler and this conduit 20.

After reheating in the heat exchange line, this medium pressure gaseous oxygen constitutes a fourth product of the installation, which is recovered via a conduit 21.

FIG. 1 also shows a conduit 22 for purging liquid oxygen from the sump of the column.

It is also possible, simply by choosing the number of plates 17 and 18, to produce oxygen of the desired purity, in addition to nitrogen, which constitutes the great majority of the product of the installation. Likewise, in the process of European application 413,631 described above, the reflux of the column may be controlled by the flow rate of high pressure recycled nitrogen at 14, independently of the production of nitrogen and oxygen.

Figure 2:
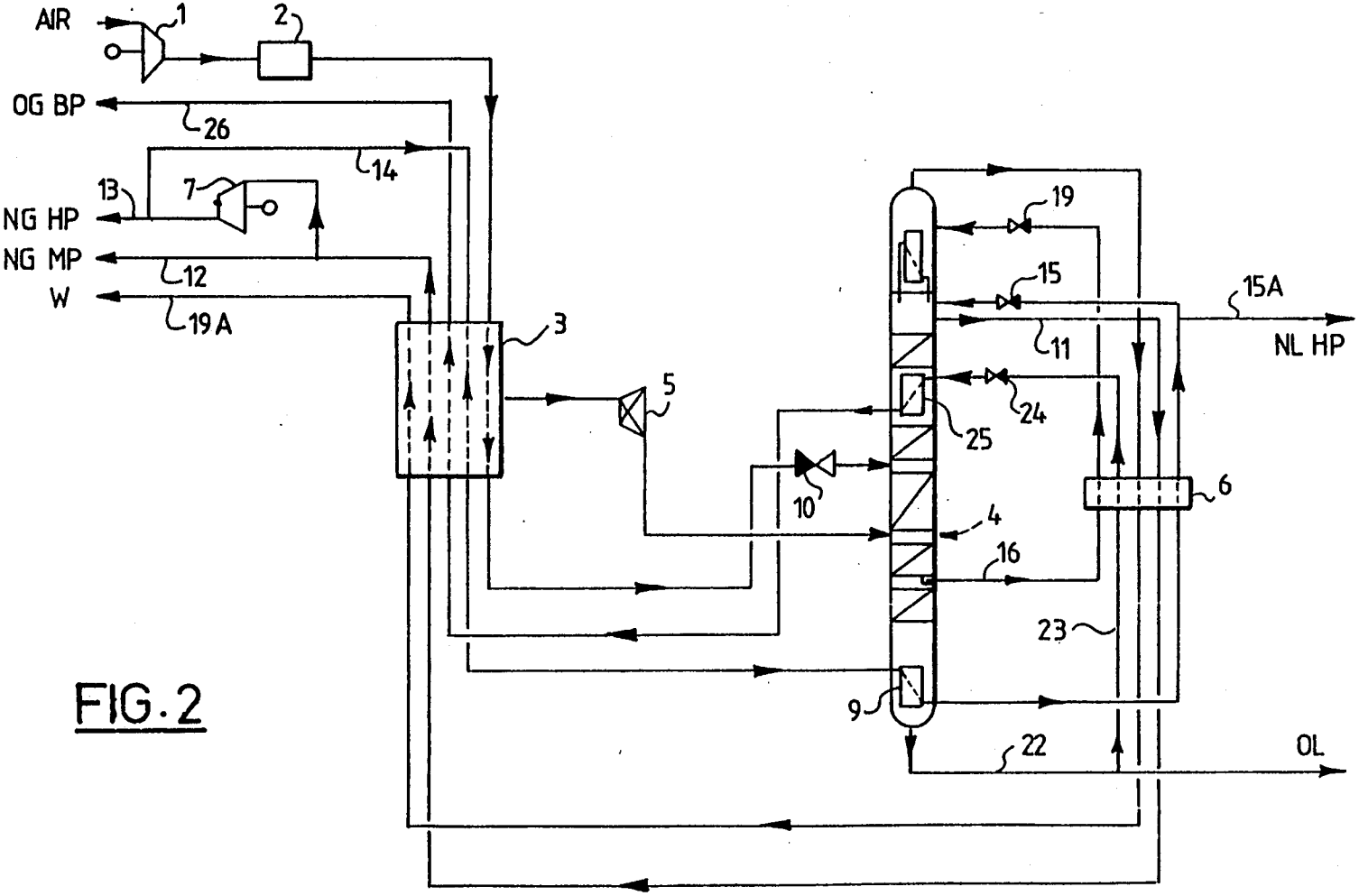

The embodiment of FIG. 2 differs from that of FIG. 1 only in the manner by which gaseous oxygen is obtained from the liquid in the sump of the column.

Specifically, in this case, the conduit 20 is eliminated, and a conduit 23 is branched onto the conduit 22. The liquid oxygen transported by this conduit 23 is supercooled at 6, expanded in an expansion valve 24 and introduced into an auxiliary condenser 25 mounted in the column 4 below the head condenser 8, to be vaporized therein. As before, the expression "below" signifies that a certain number of distillation plates exist between the two condensers.

Low pressure gaseous oxygen is thus produced, reheated in the heat exchange line and thereafter recovered via a conduit 26.

This embodiment permits augmenting the reflux in the column 4, together with the production of gaseous oxygen under low pressure.

Figure 3:
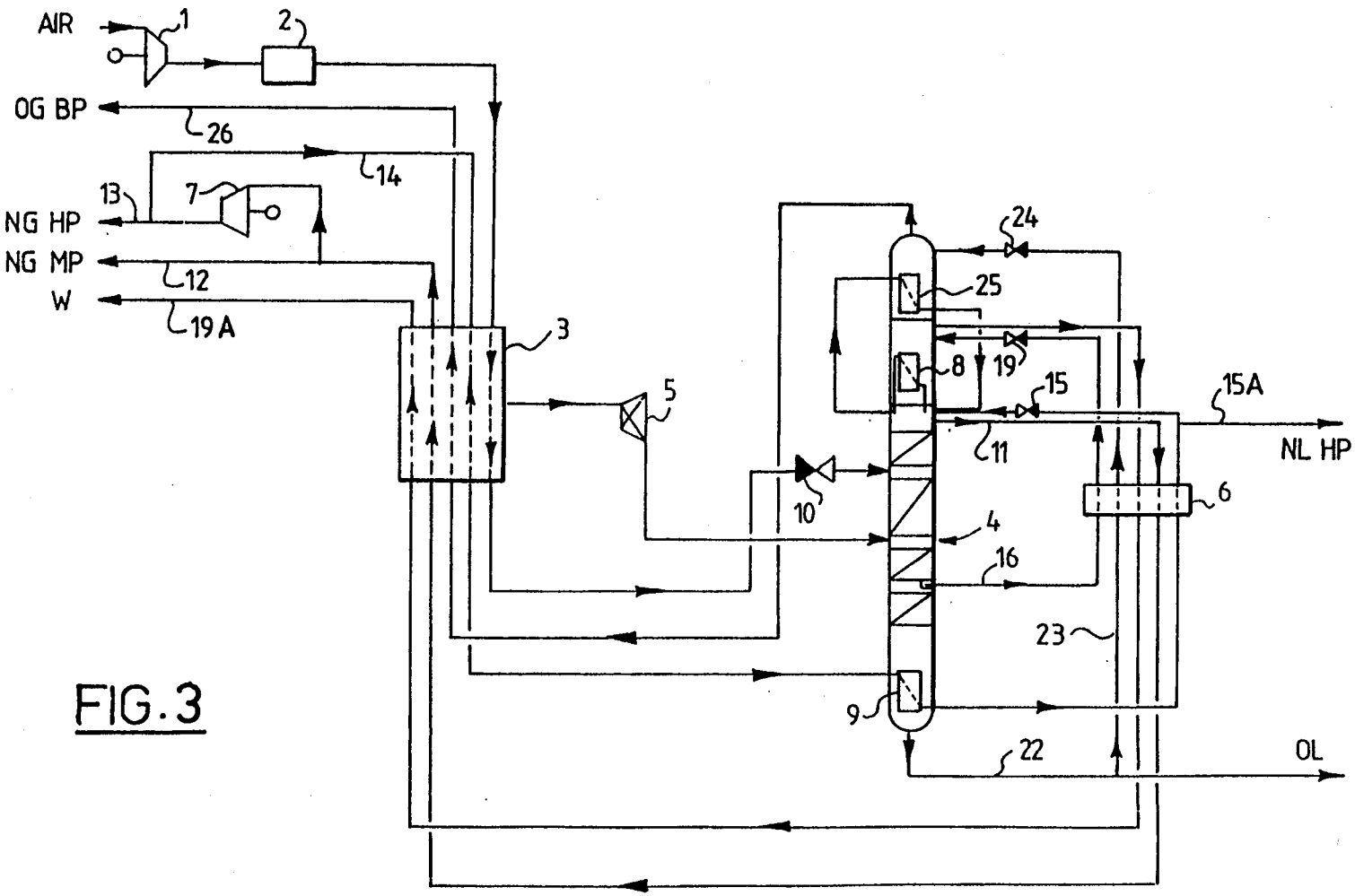

The embodiment of FIG. 3 differs from the previous ones only by the fact that the auxiliary condenser 25 is mounted in parallel with the head condenser 8 and thus constitutes a second head condenser of the column. The manufacture of the column is thereby simplified, but, on the other hand, it is necessary to slightly increase the pressure of the vaporized rich liquid and thus the pressure of the entering air.

It will be understood that the present invention may be applied to the various embodiments described in the abovementioned European application 413,631.

What is claimed is:

1. Process for producing a majority of nitrogen and a minority of oxygen by distilling a gaseous mixture, comprising:

cooling the gaseous mixture and thereafter introducing it at an intermediate level of a distillation column (4) operating at a medium pressure and equipped with a head condenser (8) and a sump reboiler (9);

vaporizing in the head condenser liquid richer in oxygen than is said gaseous mixture, withdrawn from said column below the introduction point of the gaseous mixture, after expansion (at 19) to a low pressure less than the medium pressure;

withdrawing gaseous nitrogen from the head condenser and reheating it, with a portion thereof being compressed to a high pressure greater than the medium pressure, cooled and introduced into the reboiler (9) to be condensed therein; and expanding (at 15) at least a portion of the liquid nitrogen thus obtained to the medium pressure and introducing it into the head of the column;

wherein:

said liquid is withdrawn at an intermediate level between the level of gaseous mixture introduction into said column and the reboiler; and liquid in the sump of the column is vaporized and recovered as a minority product consisting essentially of oxygen.

2. Process according to claim 1, wherein the sump liquid intended to constitute said minority product is vaporized by the reboiler (9) and withdrawn in gaseous form immediately above this latter.

3. Process according to claim 1, wherein the sump liquid intended to constitute said minority product is expanded (at 24) and thereafter vaporized in an auxiliary condenser (25) provided in the upper part of the column (4).

4. Process according to claim 3, wherein the auxiliary condenser (25) is arranged below the head condenser (8).

5. Process according to claim 3, wherein the auxiliary condenser (25) is arranged in parallel with the head condenser (8), said sump liquid being expanded (at 24) to a pressure lower than the said low pressure.

6. Process according to claim 1, wherein the gaseous mixture is air. recovering the resulting gas, consisting essentially of oxygen, as a minority product of the installation.

7. Process according to claim 1, wherein liquid in the sump of the column is richer in oxygen than is said withdrawn liquid.

8. Process according to claim 1, and providing in said column solid surfaces (17, 18) for liquid-vapor mass transfer between said introduction point of gaseous mixture and said sump, some (17) of said solid surfaces being below said point of introduction of gaseous mixture but above said intermediate level of withdrawal of said liquid and others (18) of said surfaces being above said sump but below said intermediate level of liquid withdrawal.

9. Installation for producing a majority of nitrogen and a minority of oxygen by distillation of a gaseous mixture, comprising:

a distillation column (4) operating under a medium pressure and equipped with a head condenser (8) and a sump reboiler (9);

means (1, 2, 3, 5) for compressing, purifying and cooling the gaseous mixture and introducing it at an intermediate level into the column;

means (16) for withdrawing a liquid richer in oxygen than is said gaseous mixture, at a level of said column lower than the level of introduction of the gaseous mixture, means (19) for expanding this liquid at a low pressure and means for introducing it into the head condenser (8) so as to vaporize it;

means (11) for withdrawing nitrogen from the head of the column, and means (6, 3, 7, 14) for reheating, compressing to a high pressure, cooling and introducing into the reboiler (9) a portion of this nitrogen; and means (15) for expanding to the medium pressure at least a portion of the liquid nitrogen issuing from the reboiler and for introducing it into the head of the column;

wherein the withdrawal level of the said liquid is intermediate between the level of introduction of the gaseous mixture into said column and the reboiler (9); and said installation further comprises means (9, 20, 21, 23 to 26) for vaporizing the liquid in the sump of the column and for recovering the resulting gas, consisting essentially of oxygen, as a minority product of the installation.

10. Installation according to claim 9, wherein the column (4) comprises a conduit (20) for withdrawing said minority product immediately above the reboiler (9).

11. Installation according to claim 9, wherein the column (4) comprises an auxiliary condenser (25) supplied with said sump liquid via a conduit (23) equipped with an expansion valve (24).

12. Installation according to claim 11, wherein the auxiliary condenser (25)is mounted at a lower level than the head condenser (8).

13. Installation according to claim 11, wherein the auxiliary condenser (25)is mounted in parallel with the head condenser (8).

14. Installation according to claim 7, wherein the point of withdrawal of said liquid is such that the liquid in the sump of the column has a higher oxygen content than said withdrawn liquid.

15. Installations according to claim 9, there being solid surfaces (17, 18) for liquid-vapor mass transfer within said column between said introduction point of gaseous mixture and said sump, some (17) of said solid surfaces being below said point of introduction of gaseous mixture but above said intermediate level of withdrawal of said liquid and others (18) of said surfaces being above said sump but below said intermediate level of liquid withdrawal.

* * * * *